United States Patent [19]

Teng

[11] Patent Number: 4,516,590

[45] Date of Patent: May 14, 1985

[54] AIR-CURED BRIGHT TOBACCO FILLER, BLENDS AND SMOKING ARTICLES

[75] Inventor: Daniel M. Teng, Richmond, Va.

[73] Assignee: Philip Morris Incorporated, New York, N.Y.

[21] Appl. No.: 444,928

[22] Filed: Nov. 26, 1982

[51] Int. Cl.[3] ..... A24B 3/14

[52] U.S. Cl. ..... 131/352

[58] Field of Search ..... 131/309, 310, 297, 298, 131/352, 364

[56] References Cited

U.S. PATENT DOCUMENTS 4,131,117 12/1978 Kite et al. ..... 131/309

FOREIGN PATENT DOCUMENTS 1372076 4/1979 Australia .

OTHER PUBLICATIONS

Broaddus, G., J. York, Jr. and J. Noseley, *Factors Affecting the Levels of Nitrate Nitrogen in Cured Tobacco Leaves,* Tobacco Science (1965) 9: 149-57.

Chaplin, J., *Comparison of Type 32 and Flue-cured Tobacco Cultivars Produced Under Flue-cured Culture when Air-cured, Tobacco Science (1975) XIX:112-114.*

Tso, T. et al., *Nitrogenous and Phenolic Compounds of Nicotiana Plants: I. Field and Greenhouse Grown Plants,* Tobacco Science (1967) 11: 133-136.

Wynder, E. L. and D. Hoffmann, *Tobacco and Tobacco Smoke, Studies in Experimental Carcinogenesis,* Academic Press, 1967 Chapter 3.

Yoshida, D. and A. Hirato, *Effects of Cultural Practices on the Tar Content in the Smoke of Cigarettes: V Effect of Flue-curing and Air-curing on the Tar Content in the Smoke,* Hatano, Japan Tobacco Exp. Station Bull. (1970) 67: 97-104.

Atkinson, W., *Comparison of Stalk-cured and Primed Burley Tobacco for Yield, Value and Certain Chemical and Physical Properties of the Cured Leaf,* Tobacco Science (1963) 7: 183-186.

Burton, W. and H. Wright, Jr., *Burley Tobacco. The Effects of Harvesting and Curing Procedures on the Composition of the Cured Leaf,* Tobacco Science (1961) V: 49-53.

Jenson, C. O. *Cigar Tobaccos, Chemical Changes that Occur During Curing,* Ind. Eng. Chem. (1952) 44: 306-309.

Sheen, S., C. Grunwald and J. Sims, *Effects of Nitrogen Fertilization and Stalk Position on Polyphenols and Carbohydrates in the Air-Cured Leaf of Three Tobacco Genotypes,* Can. J. Plant. Sci. (1973) 53: 897-905.

Sims, J., S. Sheen, C. Grunwald and W. Atkinson, *Effects of Nitrogen Fertilization and Stalk Position on Certain Chemical and Physical Characteristics of Three Tobacco Genotypes,* Can. J. Plant Sci. (1975) 55: 485-490.

Azimi, H., *Comparison of Stalk Harvested and Primed Burley Tobacco for Yield, Value and Certain Chemical and Physical Components of the Cured Leaf,* Coresta Information Bulletin (1979) 4: 34-38.

Tomita, H., *Studies on the Curing of Tobacco Leaves,* Bull. Morioka Tob. Exp. Station (Japan, 1968) 3: 149-74.

Pyriki, C., and R. Muller, *On the Protein and Protein--Like Compounds in Tobacco, 4th Communication Modifications of Protein and Protein like Compounds During Different Tobacco Curing and Fermentation Process.* Berichte Institute Tabakforsch, Dresden, Band 11 Heft 2 pp. 183-200 (1964).

*Primary Examiner*—V. Millin

[57] ABSTRACT

A novel tobacco for smoking articles which is an air-cured bright tobacco harvested by stalk cutting, priming, or a combination of partial priming followed by stalk cutting, and characterized by a total reducing sugar content within the range of from 0 to about 6%, a chlorogenic acid content within the range of from 0 to about 0.4%, a rutin content within the range of from 0 to about 0.2%, a hot water solubles content within the range of from about 45 to about 55%, a total ash content within the range of from about 12 to about 26%, a combined proline and threonine content within the range of from 0 to about 1 mg/g, a combined aspartic acid and asparagine content within the range of from about 0.5 to about 7 mg/g, and a combined glutamic acid and glutamine content within the range of from about 0.5 to about 1.6 mg/g; all measurements being on a dry weight basis. This novel tobacco, when formulated as a smoking article, such as a cigarette, and smoked, presents the aroma and taste of a blended tobacco smoking article and may be substituted in whole or in part for burley tobacco in blended tobaccos while substantially maintaining the subjective qualities of the burley tobacco and yet, as compared to the burley tobacco-containing blends, provides a reduced NO content in the smoke.

18 Claims, No Drawings

AIR-CURED BRIGHT TOBACCO FILLER, BLENDS AND SMOKING ARTICLES

BACKGROUND OF THE INVENTION

The present invention relates to cured tobacco. More particularly, the present invention relates to a novel bright tobacco filler and to tobacco blends and smoking articles containing this tobacco.

Of the more than sixty genetic species of plants belonging to the genus Nicotiana, only two of them, *N.tabacum* and *N.rustica,* are cultivated for use as tobacco. The first is grown in appreciable amounts in nearly 100 countries throughout the world and constitutes the tobacco of commerce, whereas the second is grown extensively in parts of Eastern Europe and Asia Minor.

*N.tabacum* is a natural hybrid between *N.sylvestris* and *N.otophoria* and is a plastic, very adaptable. polymorphic species as evidenced by the different types and the numerous agronomic varieties in each of the types. The commercially important types are known as Virginia or flue-cured, burley, Maryland, cigar tobaccos, and oriental or aromatic, tobaccos, all of which are used in the manufacture of smoking articles such as cigarettes, cigars and cigarillos.

Tobacco is cultivated widely throughout the world, indicating that it is adaped to a wide range of edaphic (i.e., soil) and meterologic (i.e., climatic) conditions. The leaf produced in each locality differs from leaves produced in the other localities. Both edaphic and climatic factors vary in each tobacco-growing locality, but they also vary appreciably in any given locality from year to year. Each factor is capable of modifying the physical and chemical properties of the leaf produced.

A cured tobacco leaf is not just a dried leaf of tobacco. Each green leaf on any given plant differs from all of the other leaves in age, size, color, proportion of length to width, thickness, and amounts and distribution of chemical constituents. Consequently, the cured leaves differ markedly in physical and chemical features and these differences constitute, in part, the basis for commercial grades of leaf. These physical and chemical differences correlate with the position at which the leaf is borne on the stalk, and the stalk position serves as the primary basic for classification of leaf in the grades.

Certain cultural practices are employed to cause physical and chemical changes in the leaf. These practices include topping, suckering, priming, and the application of mineral and organic fertilizer as well as of suckering inhibitors. "Topping" is the term applied to the removal of the inflorescence. "Suckering" applies to the removal of axillary buds that grow after the plants have been topped. "Priming" means removal of leaves at successive intervals, as they mature. The number of primings, usually 5 to 8 depends upon the type of tobacco and the kind of weather that prevails throughout the harvesting. Essentially all flue-cured tobaccos are harvested by the priming method. Nearly all burley tobaccos are stalk-cut in the United States but may be either primed or stalk cut in other tobacco-growing countries.

Once the mature green leaf is harvested, it is subjected to such conditions of humidity and temperature as will permit it to cure. There are essentially four kinds of curing processes, namely, flue-curing, air-curing, fire-curing and sun-curing, each of which is an aerobic process. Virginia tobacco is flue-cured while burley is air-cured. A distinctive difference between air-curing and flue-curing is that in the air-curing process the soluble sugars content of burley is reduced essentilly to zero due to oxidations that were mostly inhibited during the flue-curing process but which occur during the air-curing process.

Curing is characterized by two processes, one of which is dehydration or water loss, and the other of which is a series of chemical changes. At the end of curing, the water content has been reduced by 80to 90% of the green leaf weight and various color changes have occurred which are due primarily to the destruction of chlorophyll and various browning reactions. The most pronounced of the chemical changes is the conversion of starch into soluble disaccharides and monosaccharides. Oxidative decompositions involving the proteins also occur but are relatively small compared to the changes in carbohydrates. Nicotine losses during curing are on the order of about 0.10%. Losses of volatile substances, about 7%, take place in the waxy, resinous materials, and the demethylation of pectins is appreciable. During the early stages of curing, respiration and other life processes occur, but they cease when the loss of water reaches a certain point. Thereafter, numerous enzymes continue to act but at reduced rates, although with flue-curing, in which the reaction rates are faster than in air-curing, many enzymes, especially the proteases, are destroyed by the heat applied during curing and thus do not continue to act.

The bulk of the tobacco is subjected to a redrying and then an aging process before it is incorporated into smoking articles. During redrying, the leaves are reheated in redrying machines in which the temperatures are raised at intervals of 80° C. or until the moisture content has been reduced to about 6% and then the leaves are permitted to reabsorb moisture under controlled conditions until their moisture content is about 9 or 10%. The leaves are then packed into hogsheads having a capacity of about 1,000 pounds or into similar such containers and then are stored 1 to 3 years to undergo aging. Instead of packing bundles of redried leaves, blade tissue may be separated from midribs by means of special threshing machines prior fto redrying, and the midribs and blade tissues packed separated. There is very little change in the chemical composition of the leaves during redrying.

American brands of cigarettes contain different proportions of different grades of Virginia, burley, Maryland, and oriental tobaccos as well as shredded or expanded stems and reconstituted tobacco. Casing solutions are added to burley blended tobaccos. Humectants, consisting of glycerol and glycols, are also added before cutting. The blend is passed through cutting, drying, and then cooling machines in which alcohol-soluble flavors such as fruit extractives, tonka bean extract, menthol, oil of peppermint, oil of cloves, oil of cinammon, or other aromatic substances may be applied. After storage for several hours, the tobacco is fed to the cigarette-making machines.

As used herein, the following terms have the indicated meanings.

Filling Power

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco and also by expanding tobacco.

Cylinder Volume (CV)

The volume that a given weight of shredded tobacco occupies under a definite pressure. The CV value is expressed as cc/10 g. To determine this value, tobacco filler weighing 10,000 g is placed in a 3.358 cm diameter cylinder and the cylinder is vibrated for 30 seconds on a "Syntron" vibrator and the tobacco is then compressed by an 1875 g piston, 3.33 cm in diameter, for 5 minutes. The resulting volume of tobacco is reported as cylinder volume. This test is carried out at standard environmental conditions of 23.9° C. and 60% relative humidity (RH). A high cylinder volume indicates a high filling power.

Equilibrium Cylinder Volume ($CV_{eq.}$)

The cylinder volume determined after the tobacco filler has been equilibrated by conditioning at 23.9° C. and 60% RH, typically for 18 hours, although conditioning for 4 to 5 hours is also acceptable.

Oven-Volatiles Content (OV)

A value indicating the moisture content (or percentage of moisture) of tobacco. It is determined by weighing a sample of tobacco filler before and after treatment for three hours in a circulating air oven at 100° C. The weight loss as a percentage of initial weight is the oven-volatiles content. The weight loss is attributed to volatiles in addition to water but OV is used interchangeably with moisture content and may be considered equivalent thereto since, at the test conditions, not more than about 1% of the tobacco filler weight is volatiles other than water.

Equilibrium Oven-Volatiles Content ($OV_{eq.}$)

The OV value as determined after the tobacco filler has been equilibrated by conditioning at 23.9° C. and 60% RH for 18 hours.

Specific Volume (SV)

The volume of a predetermined amount of tobacco divided by the weight of the tobacco. The SV value is expressed as cc/g. The "$SV_{acetone}$" value may be determined by a simple application of the weight in air versus weight in liquid method according to which a one-gram sample of tobacco is placed in a porous container which is then weighed, submerged in acetone, and reweighed. The "$SV_{Hg}$" value is determined by placing a known weight of a tobacco sample in a sealed chamber of known volume and weight and then evacuating the air in the chamber to a pressure of 1 torr. An amount of mercury is then admitted to the sample chamber in a manner such that the interfacial pressure between the mercury and the tobacco limits the intrusion of mercury into the porous structure. The volume of mercury displaced by the tobacco sample of known weight at an interfacial pressure of 52 to 104 torr absolute is expressed as $SV_{Hg}$ in cc/g. Specific volume differs from cylinder volume in that the tobacco is not compressed and in that the SV measurement excludes the inter-particle space or volume which contributes to the CV measurement. As specific volume increases, filling power also increases.

Equilibrium Specific Volume ($SV_{eg.}$)

The SV value determined after the tobacco filler has been equilibrated by conditioning at 23.9° C. and 60% RH for about 18 hours.

Tobacco Filler

This term is intended to include shredded, cured tobacco exclusive of the large stems. The tobacco may be cased or uncased and may have been treated according to a known expansion process.

Aging

A mild state of fermentation, usually carried out in a hogshead in compressed conditions for several years, with a moisture content ranging from 10 to 13%. Loss of dry matter is about 1 to 2% for flue-cured and 3 to 4% for air-cured leaves. During aging of Virginia-type tobaccos, a slow decline in percentage composition of organic substances occurs. The most significant changes involve the sugars and amino nitrogen.

Blended Tobacco

A mixture of different grades and/or types of tobacco fillers and/or reconstituted tobacco. American cigarette blends typically contain 40 to 75% flue-cured, 14 to 45% burley, 1 to 5% Maryland, 5 to 15% oriental, and 5 to 20% reconstituted tobacco.

Casing a mixture of hygroscopic agents and volatile or non-volatile flavoring agents applied to tobacco to condition it for processing (to reduce breakage, facilitate cutting, etc.) Some commonly known flavoring agents are: cocoa, balsams, chocolate, licorice, ginger, cinnamon, vanilla, molasses, liatris, rum brandy, maple syrup, certain esters, angelica, oil of anise, oil of juniper, oil of clovers, honey and sugar.

Coker 319

A variety of leaf of flue-cured tobacco.

Air-Curing

Air-curing is performed in widely ventilated barns under natural atmospheric conditions (from which the name comes) with little or no artifical heat; it takes 3 to 12 weeks. This procedure is characterized by slow gradual drying of the leaf which is typically harvested by cutting the tobacco plant off at ground level (i.e., stalk-cutting). The harvested tobacco may be wilted in the field and placed in sheds or barns that permit the regulated flow of air. If humid weather prevails during curing, it may be necessary to employ a charcoal fire to raise the temperature within the barn and at the same time provide a relative humidity within the range of from 65 to 75%.

Normally, air-cured leaves reach the "yellow stage" about 10 to 12 days after harvesting, and 6 or 7 days later the "brown stage" is reached. Thirty to forty days are required to reach the "complete" stage. At the end of the process, the water content has been reduced by 80 to 85% of the green leaf weight. There is a translocation of substances from the leaves to the stalks.

Flue-Curing

In the flue-curing process, which derives its name from the metal flues used in the heating apparatus, primed leaves in hands or groups of from two to four leaves are tied to sticks and hung in tiers in small, tightly constructed barns which, when filled, are closed to maintain a high relative humidity at ambient temperatures within the range of from about 30° to about 35° C. for from about 24 to about 36 hours. A low fire may be required for such temperatures. Under these conditions, the first stage of curing, the yellowing stage, occurs and, as the chlorophylls are decomposed, the yellow colors of xanthophyll and carotene become apparent. Once the leaves have retained yellow colors, the temperatures are gradually raised to within the range of from about 50° to about 60° C. and are maintained within that range for from about 12 to about 24 hours to fix the colors. This is known as the fixing stage. Water loss is small during the yellowing stage, but the blade tissues become completely descicated in the fixing stage. Once the colors have been fixed, the temperatures are gradually raised to within the range of from about 70° to about 75° C. and are maintained within that range for from 24 to about 72 hours, during which time the midribs (i.e., stems) become dry and brittle. The entire process requires a period of from about 5 to about 8 days. As soon as curing is completed, it is necessary to extinguish the fire and open the barn overnight to permit the leaves to reabsorb moisture. By so doing, the leaves become pliable and can be handled without breakage.

Flue-Cured Tobacco

Commonly called bright or Virginia tobacco, flue-cured tobacco is yellowish to reddish-orange in color, thin to medium in body, and mild in flavor. Flue-cured tobacco possesses a sweet aroma and a slightly acidic taste. It is high in sugar content and low to average in nitrogenous materials, acids, and nicotine. It blends well with burley and Maryland tobaccos because its sugar content smooths and neutralizes the smoke.

Burley Tobacco

An air-cured tobacco normally grown in rich soils. Itis light brown to reddish brown in color and has a somewhat greater filling power than flue-cured tobacco. It has a low carbohydrate content and a high content of nitrogenous materials, nicotine and nonvolatile acids.

Oriental Tobacco

A class of tobaccos grown in Turkey, Greece, and neighboring areas. It is sun cured and is also known as Turkish, aromatic, or Greek tobacco. Oriental tobacco has a strong flavor, is low in nicotine, average in carbohydrates and nitrogenous materials, and high in sugars, nonvolatile acids, and volatile flavor oils.

Maryland Tobacco

A light air-cured tobacco, named after the State of Maryland. Maryland tobacco is similar to Burley but somewhat milder and lighter in taste. It is low in carbohydrates and nicotine and average in nitrogenous materials and nonvolatile acids.

Reconstituted Tobacco

Tobacco dust, tobacco stems, and tobacco by-products, that are finely ground, that may be mixed with a cohesive agent, and that are rolled into a flat sheet of uniform thickness and quality. The sheet may be cut into any size shreds. The five basic sheet processes are: dust-impingement process, calendaring process, tobacco slurry process, impregnation-of-web process, and paper process.

SUMMARY OF THE INVENTION

A tobacco filler for smoking articles is provided which comprises air-cured, stalk-cut bright tobacco having a total reducing sugar content within the range of from 0 to about 6%, a chlorogenic acid content within the range of from 0 to about 0.4%, a rutin content within the range of from about 0 to about 0.2%, a hot water solubles content within the range of from about 45 to about 55%, a total ash content within the range of from about 12 to about 26%, a combined proline and threonine content within the range of from 0 to about 1 mg/g, a combined aspartic acid and asparagine content within the range of from about 0.5 to about 7 mg/g, and a combined glutamic acid and glutamine content within the range of from about 0.5 to about 1.6 mg/g; all measurements being on a dry weight basis.

The tobacco of the present invention, when formulated as a smoking article, such as a cigarette, and smoked, presents the aroma and taste of a blended tobacco smoking article. The tobacco of the present invention may be substituted in whole or in part for burley tobacco in blended tobaccos while substantially maintaining the subjective qualities of burley tobacco, and yet, as compared to conventional burley tobacco-containing blends, provides a reduced NO content in the smoke. The air-cured bright tobacco of the present invention has a greater filling power than flue-cured bright tobacco.

DESCRIPTION OF THE PREFERRED EMBODIMENTS

The novel tobacco filler of the present invention is an air-cured stalk-cut, bright tobacco which is characterized by its total reducing sugar content, its chlorogenic acid content, its rutin content, its hot water solubles content, its total ash content, its combined proline and threonine content, its combined aspartic acid and asparagine content, and its combined glutamic acid and glutamine content.

This novel filler, which has the subjective qualities of burley tobacco when incorporated in a smoking article and smoked, and which has, as compared to burley tobacco, a reduced NO content in the smoke and an increased filling power, is defined by a total reducing sugar content in the range of from 0 to about 6%, a chlorogenic acid content in the range of from 0 to about 0.4%, a rutin content within the range of from 0 to about 0.2%, a hot water solubles content within the range of about 45 to about 55%, a total ash content within the range of from about 12 to about 26%, a combined proline and threonine content within the range of from 0 to about 1 mg/g, a combined aspartic acid and asparagine content within the range of from about 0.5 to about 7 mg/g, and a combined glutamic acid and glutamine content within the range of from about 0.5 to about 1.6 mg/g, on a dry weight basis.

Although modifications may be required depending on the specific edaphic and meteorological conditions of the area in which the tobacco is grown, the tobacco filler of the present invention is referably obtained by growing bright tobacco according to traditional cultivation techniques for bright tobacco with a fertilization rate of about N:P:K=64:114:171 lb./acre. The mature green leaf is harvested and is then air-cured. In the United States, stalk-cutting is the preferred method of harvesting but in other tobacco-growing countries, priming, or a combination of initial, partial priming followed by stalk-cutting, is preferred. The air-cured bright tobacco may be used immediately in smoking products or it may first be subjected to an aging process, which is typically carried out in hogsheads, with the duration of aging depending on the degree desired and ranging from several months to several years at ambient conditions.

The air-cured bright tobacco of the present invention may be used to form 100% bright tobacco smoking articles, such as cigarettes, cigars, cigarillos or the like, according to conventional manufacturing techniques, or may be blended with other tobacco fillers such as oriental, burley, Maryland, flue-cured bright, reconstituted tobacco and processed (i.e., shredded or expanded) tobacco stems.

The preferred blended tobacco of the present invention comprises from 5% to 100% of the air-cured bright tobacco of the present invention, from 0 to 50% burley tobacco filler, from 0 to 30% oriental tobacco filler, from 0 to 60% reconstituted tobacco, from 0 to 10% processed tobacco stems and from 0 to 95% flue-cured bright tobacco filler, with all precentages being by weight of the total blend. The NO content of the smoke may be progressively reduced by substituting increasing amounts of the air-cured bright tobacco filler of the present invention for the burley tobacco in the blend, and may be further reduced by also substituting the tobacco of the present invention for the reconstituted tobacco in the blend. Even greater reductions can be obtained by employing denitrated reconstituted tobacco. Denitration may be accomplished by any known method, for example, microbially, or by the method of U.S. Pat. No. 4,131,117.

Another preferred blended tobacco of the present invention comprises from 5% to 100% of the bright tobacco filler of the present invention, from 0 to 30% oriental tobacco filler, from 0 to 60% reconstituted tobacco, from 0 to 10% processed tobacco stems, and from 0 to 95% flue-cured bright tobacco filler, with all percentages being by weight of the total blend. The burley and reconstituted tobacco may be substituted as in the preceding blend. In a particularly preferred embodiment, this blended tobacco will contain about 20% reconstituted tobacco and about 25% of the air-cured tobacco filler of the present invention, by weight of the total blend.

A preferred blend which has a low NO content in the smoke, comprises 60 to 100% of the air-cured bright tobacco filler of the present invention, from 0 to 30 % oriental tobacco filler and from 0 to 10% processed tobacco stems, by weight of the total blend. More preferably, this blend comprises about 50%, by weight of the total blend, of the filler of the present invention.

A particularly preferred blended tobacco having a substantially reduced NO content in the smoke comprises from about 40 to about 95%, by weight of the total blend, of the tobacco filler of the present invention and from about 5 to about 60%, by weight of the total blend, of denitrated reconstituted tobacco.

The present invention includes within its scope smoking articles, such as cigarettes, which are fabricated employing either 100% of the air-cured bright tobacco of the present invention or one of the aforementioned tobacco blends. The tobacco may be cased or not, as desired, using commercially available flavorants and the like.

The preferred embodiments are further characterized by the following examples. Comparative examples are also presented.

The bright tobacco (Coker 319) employed in examples 1 through 6 was grown in Virginia according to bright tobacco regime with a fertilization rate of N:P:K=64:114: 171 lb./acre. Bright tobacco leaves from the bottom one-third of the stalk were primed and flue-cured while other plants were stalk-cut at the same time and air-cured. When the middle one-third of the leaves reached normal ripeness, they were primed and flue-cured while other plants were stalk-cut and air-cured. This allowed the middle one-third of the leaves to grow to the same dimension as the leaves used in flue-curing. Leaves from the top one-third of the stalk were processed in the same manner. All curings were conducted according to conventional methods for flue-curing and air-curing. Leaf samples were hand stemmed and processed in a pilot plant facility.

EXAMPLE 1

The air-cured, stalk-cut, bright tobacco from the bottom, middle, and top of the plant and the flue-cured bright tobacco from the bottom, middle, and top of the plant were subjected to chemical analysis. The results of this analysis are summarized below in Table 1 and in Table 2.

TABLE 1

CHEMICAL COMPOSITION OF BRIGHT TOBACCO (Coker 319) (Dry Weight Basis)

| | | Bottom | | Middle | | Top | |
|---|---|---|---|---|---|---|---|
| | | Flue[1] | Air | Flue[1] | Air | Flue[1] | Air |
| Total-N | (%) | 2.14 | 1.80 | 2.20 | 2.28 | 2.33 | 3.18 |
| Insoluble-N | (%) | 0.90 | 0.46 | 0.96 | 1.03 | 0.97 | 1.37 |
| α-Amino-N | (%) | 0.54 | 0.48 | 0.30 | 0.20 | 0.19 | 0.24 |
| Soluble-$NH_3$—N | (%) | <0.1 | <0.1 | T[2] | 0.1 | 0.2 | 0.1 |
| Nitrate-N | (%) | 0.05 | 0.09 | T[2] | T[2] | <0.04 | <0.04 |
| Total Reducing Sugar | (%) | 8.1 | T[2] | 18.9 | 6.0 | 21.5 | <2.0 |
| Glucose | (%) | 4.1 | N.D.[3] | 8.9 | 2.1 | 10.2 | 0.7 |
| Fructose | (%) | 4.1 | N.D.[3] | 8.0 | 1.6 | 9.6 | 0.8 |
| Sucrose | (%) | 3.7 | 0.2 | 4.3 | N.D.[3] | 4.3 | 0.2 |
| Total Alkaloids | (%) | 1.64 | 1.36 | 2.98 | 2.79 | 3.80 | 3.94 |
| Petroleum Ether Extractables | (%) | 6.5 | 7.2 | 6.3 | 8.2 | 6.7 | 9.4 |
| Chlorogenic acid | (%) | 1.00 | <0.4 | 1.55 | N.D.[3] | 1.45 | N.D.[3] |
| Rutin | (%) | 0.59 | <0.16 | 0.57 | 0.16 | 0.90 | <0.16 |
| Hot Water Solubles | (%) | 63 | 50 | 67 | 53 | 66 | 50 |

TABLE 1-continued

CHEMICAL COMPOSITION OF BRIGHT TOBACCO (Coker 319) (Dry Weight Basis)

| | | Bottom | | Middle | | Top | |
|---|---|---|---|---|---|---|---|
| | | Flue[1] | Air | Flue[1] | Air | Flue[1] | Air |
| Total Ash | (%) | 19.4 | 25.7 | 11.2 | 14.0 | 7.5 | 12.2 |
| Ca | (%) | 3.5 | 3.8 | 1.9 | 2.4 | 1.4 | 2.0 |
| Malic acid | (%) | 3.1 | 12.0 | 6.4 | 5.9 | 2.6 | 3.5 |
| Citric acid | (%) | 0.7 | 3.5 | 0.5 | 1.4 | 0.7 | 1.0 |
| Oxalic acid | (%) | 1.1 | 2.4 | 1.3 | 1.7 | 1.2 | 1.8 |
| Acetic acid | (μg/g) | 602 | 277 | 802 | 494 | 697 | 199 |
| Propionic acid | (μg/g) | 8 | 14 | 11 | T[2] | 11 | 8 |
| Butyric acid | (μg/g) | 8 | 9 | 9 | 8 | 5 | 6 |

[1]Comparative
[2]T = trace
[3]N.D. = not detected

The nitrate content, which is very low, is attributable, in part, to the traditional cultivation practice for bright tobacco, which employs a low rate of nitrogen fertilization. The total reducing sugars are lower in the air-cured as compared with the flue-cured leaves for the same stalk position while the petroleum ether extractables are higher in the air-cured than in the flue-cured. Due to the more pronounced loss of starch, sugar and some relatively susceptible compounds during air-curing, as compared with flue-curing, the relative weight percentage of petroleum ether extractables is higher for the air-cured leaves. The lower hot water solubles fraction in the air-cured tobacco is attributable to the pronounced changes in soluble carbohydrates, amino acids, polyphenols and other susceptible compounds.

TABLE 2

AMINO ACID COMPOSITION OF BRIGHT TOBACCO (Coker 319)[1]

| | Bottom | | Middle | | Top | |
|---|---|---|---|---|---|---|
| | Flue[2] | Air | Flue[2] | Air | Flue[2] | Air |
| Alanine | 0.62 | 0.30 | 0.52 | 0.40 | 0.88 | 0.50 |
| Valine | 0.21 | — | 0.09 | 0.12 | <0.1 | <0.1 |
| Glycine | <0.1 | — | 0.03 | 0.07 | <0.1 | <0.1 |
| Isoleucine | <0.1 | 0.13 | 0.05 | 0.07 | 0.19 | 0.12 |
| Leucine | <0.1 | — | 0.05 | 0.13 | <0.1 | 0.10 |
| Proline & Threonine | 2.64 | <0.1 | 10.3 | 0.97 | 3.50 | 0.68 |
| Serine | 0.32 | — | 0.15 | 0.08 | <0.1 | <0.1 |
| Phenylalanine | 1.24 | — | 0.44 | 0.05 | 0.14 | 0.12 |
| Aspartic & Asparagine | 3.06 | 0.54 | 1.08 | 0.56 | 0.53 | 1.68 |
| Glutamic & Glutamine | 4.46 | 0.51 | 1.71 | 0.60 | 0.50 | 1.56 |
| Lysine | — | — | 0.05 | 0.04 | — | — |

[1]Values given are mg/g, dry weight basis
[2]Comparative

The amino acid contents summarized in Table 2 were determined by a gas chromatographic procedure. Due to the nature of the sample preparation and determination, tryptophane was not determined and proline and threonine were combined. Aspartic acid-asparagine is reported as aspartic, and glutamic acid-glutamine is reported as glutamic. The air-cured leaves evidence a greater reduction in amino acids, especially in proline, aspartic and glutamic (with the exception of the top stalk leaves) than the flue-cured leaves.

EXAMPLE 2

Tobacco strips were cut from the same location in flue-cured and air-cured bright tobacco leaves from the same stalk position. Ten leaves for each sample were used to obtain 774 square centimeters of strips for weight measurement. $CV_{eq}$, $OV_{eq}$ and $SV_{eq}$ were determined. Portions of each sample were treated according to the carbon dioxide process disclosed in U.S. Pat. No. 4,340,073 (302° C., 40 m./sec. air, 100% steam) to expand the tobacco. The $CV_{eq}$ and $OV_{eq}$ values for the expanded samples were determined. All of these values are summarized below in Table 3.

TABLE 3

PHYSICAL CHARACTERISTICS OF BRIGHT TOBACCO (Coker 319)

| | Bottom | | Middle | | Top | |
|---|---|---|---|---|---|---|
| | Flue[1] | Air | Flue[1] | Air | Flue[1] | Air |
| Wt. (g/774 cm$^2$) (DWB[2]) | 4.59 | 3.24 | 6.67 | 4.09 | 8.72 | 6.14 |
| ΔWt. (%) | −29.4 | | −38.7 | | −29.6 | |
| CVeq. (cc/10 g) | 32.5 | 53.7 | 21.3 | 52.1 | 21.2 | 52.5 |
| ΔCV (%) | +65.2 | | +144.6 | | +147.6 | |
| OVeq. (%) | 12.80 | 11.89 | 14.16 | 12.17 | 14.02 | 11.99 |
| $SV_{Hg}$ (cc/g) | 1.22 | 1.42 | 1.46 | 1.95 | 1.36 | 1.91 |
| CVeq.[3] (cc/10 g) | 100.5 | 121.8 | 52.7 | 119.8 | 47.2 | 131.8 |
| OVeq.[3] (%) | 11.75 | 11.04 | 12.50 | 10.47 | 12.21 | 10.05 |

[1]Comparative
[2]Dry weight basis
[3]Value determined after expansion

The results show that air-curing causes a weight loss of approximately 30 to 40% as compared with flue-cured leaves from the same stalk position. Equilibrium cylinder volumes of the cut filler samples show that air-cured tobaccos have a higher cylinder volume than the flue-cured tobacco. This higher filling power compensates for the greater weight loss experienced with air-curing. The results also show that the expanded air-cured samples have a higher equilibrium cyllinder volume than do the expanded flue-cured samples.

EXAMPLE 3

Sample cigarettes were made containing 100% bright tobacco. One sample was made using flue-cured leaves from three different positions in the weight ratio of bottom: middle:top = 1:2:2, and other sample cigarettes were made from air-cured leaves from the three different stalk positions and mixed in the same weight ratio. The cigarettes were fabricated as filter cigarettes having a circumference of 24.5 mm, an 85 mm tobacco rod containing 800 mg of tobacco, and a 21 mm cellulose acetate filter, without dilution. The cigarettes were submitted for smoke chemistry analysis and the results are summarized below in Table 4.

TABLE 4

| SMOKE CHEMISTRY OF 100% BRIGHT TOBACCO CIGARETTES[1] | Flue-Cured[2] Bright (100%) | Air-Cured Bright (100%) |
|---|---|---|
| Total RTD[3] (inches $H_2O$) | 2.9 | 3.2 |
| Total tobacco wt. (g/cigt.) | 0.939 | 0.67 |
| TPM[4] (mg/cigt.) | 42.1 | 39.4 |
| Nicotine in smoke (mg/cigt.) | 3.64 | 2.74 |
| $H_2O$ in smoke (mg/cigt.) | 6.20 | 5.74 |
| Tar (mg/cigt.) | 32.3 | 30.9 |
| Puff Count (puffs/cigt.) | 14.0 | 9.6 |
| Static burning time (min./40 mm) | 14.8 | 11.0 |
| Tobacco burned dynamically (g/cigt.) | 0.326 | 0.274 |
| Gas Phase | | |
| NO (mg/cigt.) | 0.09 | 0.10 |
| CO (mg.cigt.) | 23.2 | 23.2 |
| HCN (mg/cigt.) | 0.20 | 0.20 |
| RCHO (mg/cigt.) | 0.91 | 0.86 |
| Total-N (%) | 2.24 | 2.54 |
| Reducing Sugars (%) | 17.8 | 2.0 |

[1]No dilution
[2]Comparative
[3]Resistance to draw
[4]Total particulate matter

The difference in tobacco weight is accounted for by the substantially greater filling power of the air-cured tobacco. On a cigarette basis, the tar and gas phase component values are substantially the same for the two cigarettes.

EXAMPLE 4

Control cigarettes and five different sample cigarettes were fabricated as described in Example 3 and designed to deliver about 16 mg of tar. The control cigarettes were made from a conventional blend of tobaccos comprising, by weight of the total blend, about 30% to about 33% flue-cured bright tobacco, about 30% to about 40% burley tobacco, about 10% to about 16% oriental tobacco, and about 15% to about 25% reconstituted tobacco. This conventional blend of tobaccos also contained processed stems, such as those prepared by the process of U.S. Pat. No. 3,734,104, and the percentage given for the reconstituted tobacco component of the conventional blend represents the sum of the percentages for the reconstituted tobacco component and the processed stems component. The control cigarettes were treated with after-cut flavors and were cased with traditional burley casing.

The sample cigarettes were made by substituting the air-cured bright tobacco of the present invention for one or more of the components of the control blend, as indicated in the footnotes to Table 5 and Table 6 below. The control and the five samples were subjected to smoke chemistry analysis and the results of this analysis are summarized below in Tables 5 and 6.

TABLE 5

| SMOKE CHEMISTRY OF BLENDED CIGARETTES | Control[1] | Sample 1[2] | Sample 2[3] |
|---|---|---|---|
| Total RTD[4] (inches $H_2O$) | 4.7 | 5.1 | 5.2 |
| Total Tobacco Wt. (g/cigt.) | 0.744 | 0.825 | 0.795 |
| Blend Nitrate-N (%) | 0.19 | 0.11 | 0.11 |
| TPM[5] (mg/cigt.) | 20.3 | 21.8 | 21.9 |
| Nicotine in Smoke (mg/cigt.) | 1.07 | 1.20 | 1.36 |
| Water in Smoke (mg/cigt.) | 3.24 | 3.64 | 3.50 |
| FTC[6] Tar (mg/cigt.) | 16.0 | 17.0 | 17.0 |
| Puff Count (puffs/cigt.) | 8.9 | 10.0 | 10.1 |
| Gas Phase | | | |
| CO (mg/cigt.) | 15.4 | 15.4 | 16.3 |

TABLE 5-continued

| SMOKE CHEMISTRY OF BLENDED CIGARETTES | Control[1] | Sample 1[2] | Sample 2[3] |
|---|---|---|---|
| NO (mg/cigt.) | 0.28 | 0.18 | 0.16 |
| HCN (mg/cigt.) | 0.15 | 0.15 | 0.15 |
| RCHO (mg/cigt.) | 0.78 | 0.81 | 0.87 |

[1]Control
[2]Sample 1 = air-cured bright tobacco (30% of the total blend) cased with burley casing was substituted for the burley portion of the control.
[3]Sample 2 = uncased, air-cured bright (with after-cut flavor only) was substituted for the burley portion of the control.
[4]Resistance to draw
[5]Total particulate matter
[6]Measured according to the method disclosed in Journal Of The Association Of Official Analytical Chemists, Pillsbury et al., Vol. 52, p. 458 (1969).

Samples of both cigarettes were submitted to a panel of expert smokers and the panelists were not able to distinguish them from the control cigarette based on the same blend without the changes noted above.

TABLE 6

| SMOKE CHEMISTRY OF BLENDED CIGARETTES | Control[1] | Sample 3[2] | Sample 4[3] | Sample 5[4] |
|---|---|---|---|---|
| Total RTD[5] (inches $H_2O$) | 4.9 | 4.9 | 4.7 | 4.9 |
| Total tobacco wt. (g/cigt.) | 0.832 | 0.875 | 0.763 | 0.683 |
| Blend Nitrate-N (%) | 0.19 | | | 0.05 |
| Nicotine in Smoke (mg/cigt.) | 1.15 | 1.35 | 1.23 | 1.55 |
| FTC[6] Tar mg/cigt.) | 15.8 | 18.0 | 15.3 | 17.7 |
| Puff Count (puffs/cigt.) | 9.4 | 11.0 | 8.6 | 8.2 |
| Gas Phase | | | | |
| CO (mg/cigt.) | 14.0 | 15.2 | 15.2 | 16.4 |
| NO (mg/cigt.) | 0.26 | 0.18 | 0.10 | 0.07 |
| HCN (mg/cigt.) | 0.15 | 0.18 | 0.14 | 0.16 |
| RCHO (mg/cigt.) | 0.81 | 0.81 | 0.78 | 0.78 |

[1]Control
[2]Sample 3 = a commercial blend of ordinary flue-cured bright tobaccos substituted for the burley portion of the control. Comparative.
[3]Sample 4 = air-cured bright tobacco (25% of the total blend) substituted for the burley tobacco portion of the control, and denitrified, reconstituted tobacco substituted for the reconstituted tobacco portion of the control.
[4]Sample 5 = air-cured bright tobacco (50% of the total blend) substituted for the burley portion of the control and also for the reconstituted tobacco portion of the control.
[5]Resistance to draw.
[6]Measured according to the method disclosed in Journal Of The Association Of Official Analytical Chemists, Pillsbury et al., Vol. 52, p. 458 (1969).

The results show that when the air-cured bright tobacco of the present invention is substituted for the burley tobacco in the blend, the NO in the smoke is significantly reduced. As shown by sample 4, the reduction in NO may be increased by substituting air-cured bright tobacco for the burley tobacco and using denitrified reconstituted tobacco for the reconstituted tobacco. As shown by sample 5, the greatest reduction in NO was observed when the air-cured bright was substituted for both the burley tobacco and the reconstituted tobacco.

Cigarettes of the sample 4 type were submitted to the smoking panel and found to be similar to a control cigarette containing the same blend of components with the exception of the air-cured bright and the microbially denitrated reconstituted tobacco. Cigarettes of the sample 5 type were also submitted to the smoking panel, and although no burley tobacco was present in the blend, on smoking, the group of experienced smokers noted a distinct burley character based on taste and throat impact.

EXAMPLE 5

Cigarettes fabricated as described in example 3 and containing 100% air-cured bright tobacco were submitted to an experienced flavor panel for evaluation. Subjectively, the air-cured bright tobacco cigarettes were determined to have the characteristics of a blended tobacco cigarette. On a scale of 0 to 10, with 0 representing the subjective characteristics of flue-cured bright tobacco and 10 representing the characteristics of burley tobacco, the air-cured bright tobacco was rated 4.

EXAMPLE 6

Cigarettes were fabricated as described in Example 3 and submitted to an experienced flavor panel for evaluation. Control cigarettes were fabricated from a control blend of tobaccos, which blend was as defined for the conventional blend in example 4.

Since burley casing tends to make burley tobacco smoother than uncased burley tobacco, and since, as determined in example 5, air-cured tobacco rates in character between burley and flue-cured bright tobaccos, two samples of cigarettes were prepared. One had air-cured bright with burley casing substituted for the burley portion of the control blend. The other was prepared by substituting uncased air-cured bright for the burley portion of the control blend. Both samples were evaluated by the panelists as being very similar to the control blend cigarettes, with the second sample having more impact.

For comparative purposes, a third sample cigarette was prepared by substituting a blend of flue-cured bright tobaccos for the burley tobacco portion of the control blend to determine whether bright tobacco, regardless of the curing process, can be used to replace burley in a blended cigarette. The third sample cigarettes were evaluated as being different from the control and not having the blended cigarette characteristics.

Fourth and fifth samples of cigarettes were prepared to test the acceptibility of using air-cured Bright for low nitrate blend cigarettes. In the fourth sample cigarette, air-cured bright was substituted for the flue cured bright portion of the control, and denitrated reconstituted tobacco was substituted for the reconstitutued tobacco portion of the control. This cigarette had acceptable subjective characteristics. In the fifth sample cigarette, both the burley and the reconstituted tobacco portions of the control were substituted by the air-cured bright tobacco. It was determined that the subjective characteristics were very similar to the subjective characteristics of the control cigarettes.

In the following examples 7 and 8, 85 mm cigarettes were fabricated having conventional cellulose acetate filters (21 mm, in length). Cigarettes were submitted to an experienced flavor test panel and were also analyzed according to methods well known in the art for the determination of gas phase constituents. The cigarettes subjected to chemical analysis were smoked on a smoking machine calibrated to take 2-second, 35 cc puffs once per minute.

EXAMPLE 7

Cigarettes containing 100% air-cured bright tobacco were submitted to the flavor panel and the panelists agreed that, on smoking, the taste and aroma was similar to a blended cigarette containing both burley tobacco and flue-cured bright tobacco.

EXAMPLE 8

A control cigarette was prepared from a conrol blend of tobaccos, which blend was as defined for the conventional blend in Example 4. A second cigarette was fabricated from a blend comprising 82.5% uncased, air-cured, top stalk bright tobacco grown in the Dominican Repulic, and 17.5% reconstituted tobacco. The reconstiituted tobacco, which was low in nitrates, was made according to a modification of the process disclosed in U.S. Pat. No. 4,131,118.

Samples of the second cigarette and the control cigarette were smoked automatically and the gas phase analyzed. The results are summarized below in Table 7.

TABLE 7

| | Cigarette | |
|---|---|---|
| | 1 (Control) | 2 |
| CO (mg/cigt.) | 12.4 | 15.2 |
| NO (mg/cigt.) | 0.23 | 0.09 |
| HCN (mg/cigt.) | 0.14 | 0.17 |
| RCHO (mg/cigt.) | 0.70 | 0.66 |

Samples of each cigarette were also submitted to an expert smoking panel for evaluation. The second cigarette was somewhat neutral, with character more towards flue-cured bright to oriental rather than towards burley. Some mouth coating was noted as well as some flue-cured sweetness. It was also judged to have a blended character with moderate to low body, and some harshness, but lacked throat impact. The aftertaste was judged clean.

I claim:

1. A tobacco filler for smoking articles, comprising air-cured bright tobacco filler having, on a dry weight basis, a total reducing sugar content within the range of from 0 to about 6%, a chlorogenic acid content within the range of from 0 to about 0.4%, a rutin content within the range of from 0 to about 0.2%, a hot water solubles content within the range of from about 45 to about 55%, a total ash content within the range of from about 12 to about 26%, a combined proline and threonine content within the range of from 0 to about 1 mg/g, a combined aspartic acid and asparagine content with the range of from about 0.5 to about 1.7 mg/g, and a combined glutamic acid and glutamine content within the range of from about 0.5 to about 1.6 mg/g.

2. A blended tobacco for smoking articles, comprising, by weight of the total blend, from 5 to 100%, of the tobacco filler of claim 1, from 0 to 50% of burley tobacco filler, from 0 to 30% of oriental tobacco filler, from 0 to 60% of reconstituted tobacco, from 0 to 10% of processed tobacco stems, and from 0 to 95% of flue-cured bright tobacco filler.

3. The blended tobacco of claim 2 wherein the reconstituted tobacco is denitrated, reconstituted tobacco.

4. A smoking article, comprising a substantially cylindrical charge of tobacco wrapped in a combustible wrapper, said tobacco comprising the tobacco of claim 3.

5. A smoking article, comprising a substantially cylindrical charge of tobacco wrapped in a combustible wrapper, said tobacco comprising the tobacco of claim 2.

6. A blended tobacco for smoking articles comprising, by weight of the total blend, from 5 to 100% of the tobacco filler of claim 1, from 0 to 30% of oriental tobacco filler, from 0 to 60% of reconstituted tobacco, from 0 to 10% of processed tobacco stems, and from 0 to 95% of flue-cured bright tobacco filler.

7. The blended tobacco of claim 6 wherein the reconstituted tobacco is denitrated, reconstituted tobacco.

8. The blended tobacco of claim 5 wherein the reconstituted tobacco comprises about 20%, by weight of the total blend, and the tobacco filler of claim 1 comprises about 25%, by weight of the total blend.

9. A smoking article, comprising a substantially cylindrical charge of tobacco wrapped in a combustible wrapper, said tobacco comprising the tobacco of claim 8.

10. The blended tobacco of claim 7 wherein the tobacco filler of claim 1 comprises about 50%, by weight of the total blend.

11. A smoking article, comprising a substantially cylindrical charge of tobacco wrapped in a combustible wrapper, said tobacco comprising the tobacco of claim 10.

12. A smoking article, comprising a substantially cylindrical charge of tobacco wrapped in a combustible wrapper, said tobacco comprising the tobacco of claim 5.

13. A smoking article, comprising a substantially cylindrical charge of tobacco wrapped in a combustible wrapper, said tobacco comprising the tobacco of claim 6.

14. A blended tobacco for smoking articles comprising, by weight of the total blend, from 60 to 100% of the tobacco filler of claim 1, from 0 to 30% of oriental tobacco filler, and from 0 to 10% of processed tobacco stems.

15. A smoking article, comprising a substantially cylindrical charge of tobacco wrapped in a combustible wrapper, said tobacco comprising the tobacco of claim 14.

16. A blended tobacco for smoking articles comprising, by weight of the total blend, from about 40 to 95% of tobacco filler of claim 1, and from about 5 to 60% of denitrated, reconstituted tobacco.

17. A smoking article, comprising a substantially cylindrical charge of tobacco wrapped in a combustible wrapper, said tobacco comprising the tobacco of claim 16.

18. A smoking article, comprising a substantially cylindrical charge to tobacco wrapped in a combustible wrapper, said tobacco comprising the tobacco of claim 1.

* * * * *

UNITED STATES PATENT AND TRADEMARK OFFICE

CERTIFICATE OF CORRECTION

PATENT NO. : 4,516,590

DATED : May 14, 1985

INVENTOR(S) : Daniel M. Teng

It is certified that error appears in the above-identified patent and that said Letters Patent is hereby corrected as shown below:

Column 2, line 4, "essentilly" should be --essentially--;

column 2, line 11, "80to" should be --80 to--;

column 2, line 45, "fto" should be --to--;

column 4, line 36, "rum brandy" should be --rum, brandy--;

column 4, line 38, "clovers" should be --cloves;

column 5, line 41, "itis" should be --It is--;

column 10, line 53, "cyllinder" should be --cylinder--;

column 11, line 17, "(mg.cigt.)" should be (mg/cigt.)--;

column 12, line 29, "mg/cigt.)" should be --(mg/cigt.)--;

column 15, line 3, "5" should be --7--.

Signed and Sealed this

Twenty-fourth Day of March, 1987

*Attest:*

DONALD J. QUIGG

*Attesting Officer*

*Commissioner of Patents and Trademarks*